US007033037B2

(12) United States Patent
Chen

(10) Patent No.: US 7,033,037 B2
(45) Date of Patent: Apr. 25, 2006

(54) DAZZLING LIGHT DEVICE

(76) Inventor: Shih-Hsien Chen, No. 97, Sec. 2, Fu Nong St., Tainan City (TW)

( * ) Notice: Subject to any disclaimer, the term of this patent is extended or adjusted under 35 U.S.C. 154(b) by 0 days.

(21) Appl. No.: 11/043,139

(22) Filed: Jan. 27, 2005

(65) Prior Publication Data

US 2005/0243560 A1 Nov. 3, 2005

(30) Foreign Application Priority Data

Apr. 29, 2004 (TW) ..... 93111975 A

(51) Int. Cl.
*F21V 21/08* (2006.01)

(52) U.S. Cl. ..... 362/104; 362/282; 362/332

(58) Field of Classification Search ..... 362/103, 362/104, 154, 155, 280, 282, 327, 328, 331, 362/332, 348, 806; 63/26, 29, 30, 32
See application file for complete search history.

(56) References Cited

U.S. PATENT DOCUMENTS 4,942,744 A * 7/1990 Wei ..... 63/32
5,365,754 A * 11/1994 Nalbandian ..... 63/26
5,690,412 A * 11/1997 Sheldon ..... 362/104
6,324,869 B1 * 12/2001 Vanlioglu ..... 63/26
6,833,539 B1 * 12/2004 Maeda ..... 362/104

* cited by examiner

*Primary Examiner*—Y. My Quach-Lee
(74) *Attorney, Agent, or Firm*—Rosenberg, Klein & Lee

(57) ABSTRACT

A dazzling light device includes a shell, a gem stone and one or several lighting members. The shell comprises a holding section to hold the gem stone therein. The lighting member shines light to the gem stone which then refracts or reflects light from various angles to produce dazzling light. By rotating or moving lamp shades in relation to the gem stone, the light produces different dazzling effect.

9 Claims, 7 Drawing Sheets

DAZZLING LIGHT DEVICE

FIELD OF THE INVENTION

This invention relates to a dazzling light device, and more particularly to a light device incorporated with lamp shades to produce a dazzling light effect.

BACKGROUND OF THE INVENTION

Light devices are well used for many years by human being to assist in walking or working at a dark area. The light device comprises a shell and a lighting element (also known as a bulb or a light emitting diode) secured within the shell. When the light device is activated, the light reflects through the reflecting surface of the shell to enhance illumination.

The traditional light devices can only provide illumination without any decorating effect to attract consumers.

Thus, the inventor has derived the present invention to provide a light device, which is attractive.

SUMMARY OF THE INVENTION

It is the primary objective of the present invention to provide a dazzling light device, which attracts people's eyesight.

It is another objective of the present invention to provide a dazzling light device, which produces a dazzling light effect.

DETAILED DESCRIPTION OF THE PREFERRED EMBODIMENTS

Figure 1:
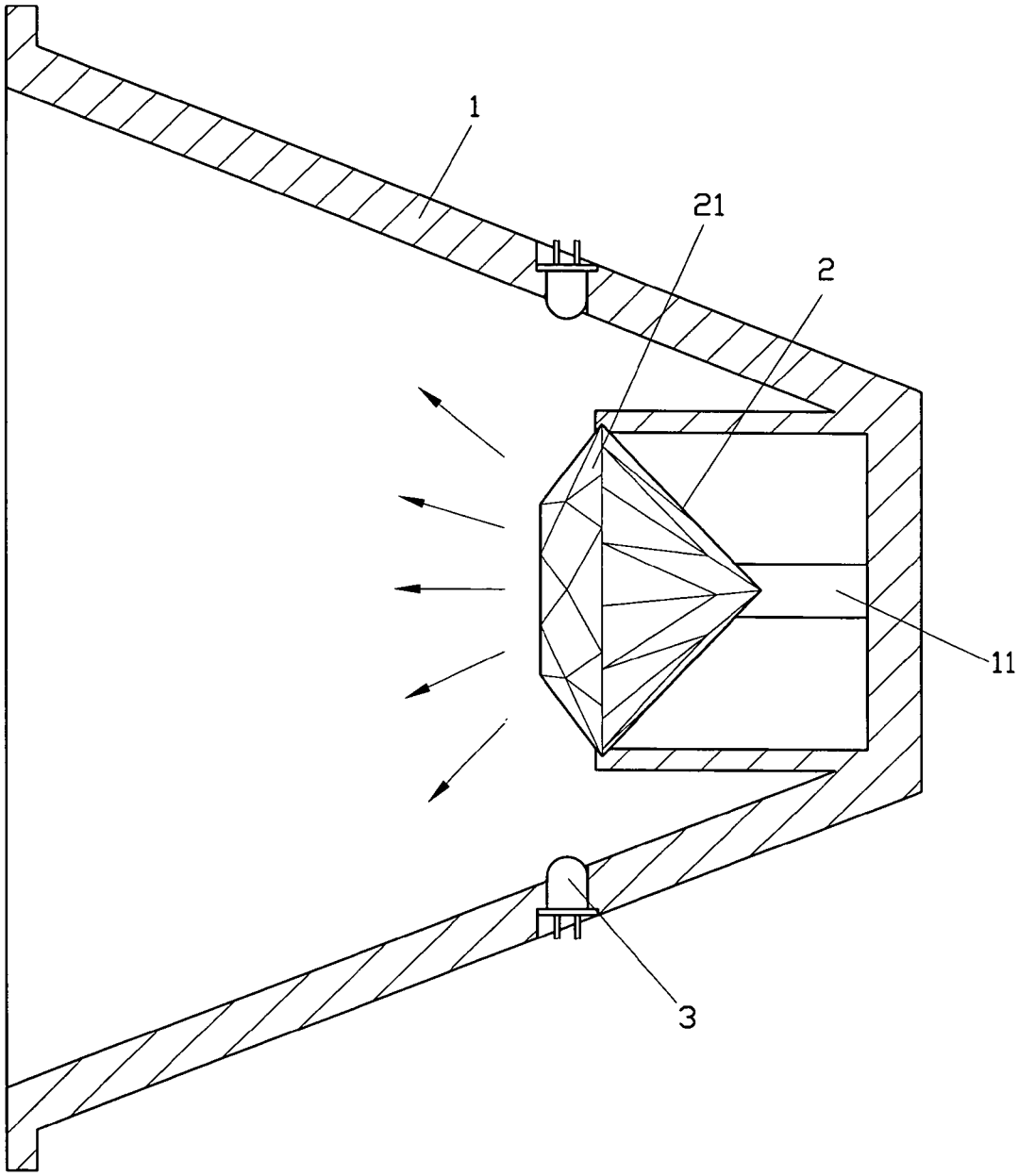
FIG. 1 is a cross-sectional view of a first embodiment of the present invention.

The present invention comprises a shell 1, a gem stone 2 and one or several lighting members 3.

The shell 1 comprises a holding section 11. (In this embodiment, the holding section 11 is consisted of a number of ribs.) The lighting member 3 is secured on the inner wall of the shell 1.

The gem stone 2 (diamond will be taken as an example in this embodiment) is secured by the holding section 11 to stay in the shell 1 firmly, and is cut in various angle surfaces 21. Due to the transparent character, the light will reflect or refract from various angles.

When the lighting member 3 is activated to illuminate, the gem stone 2 will reflect or refract the light from all of its cutting surfaces 21 and perform multiple reflections or refractions to produce dazzling light effect.

Figure 2:
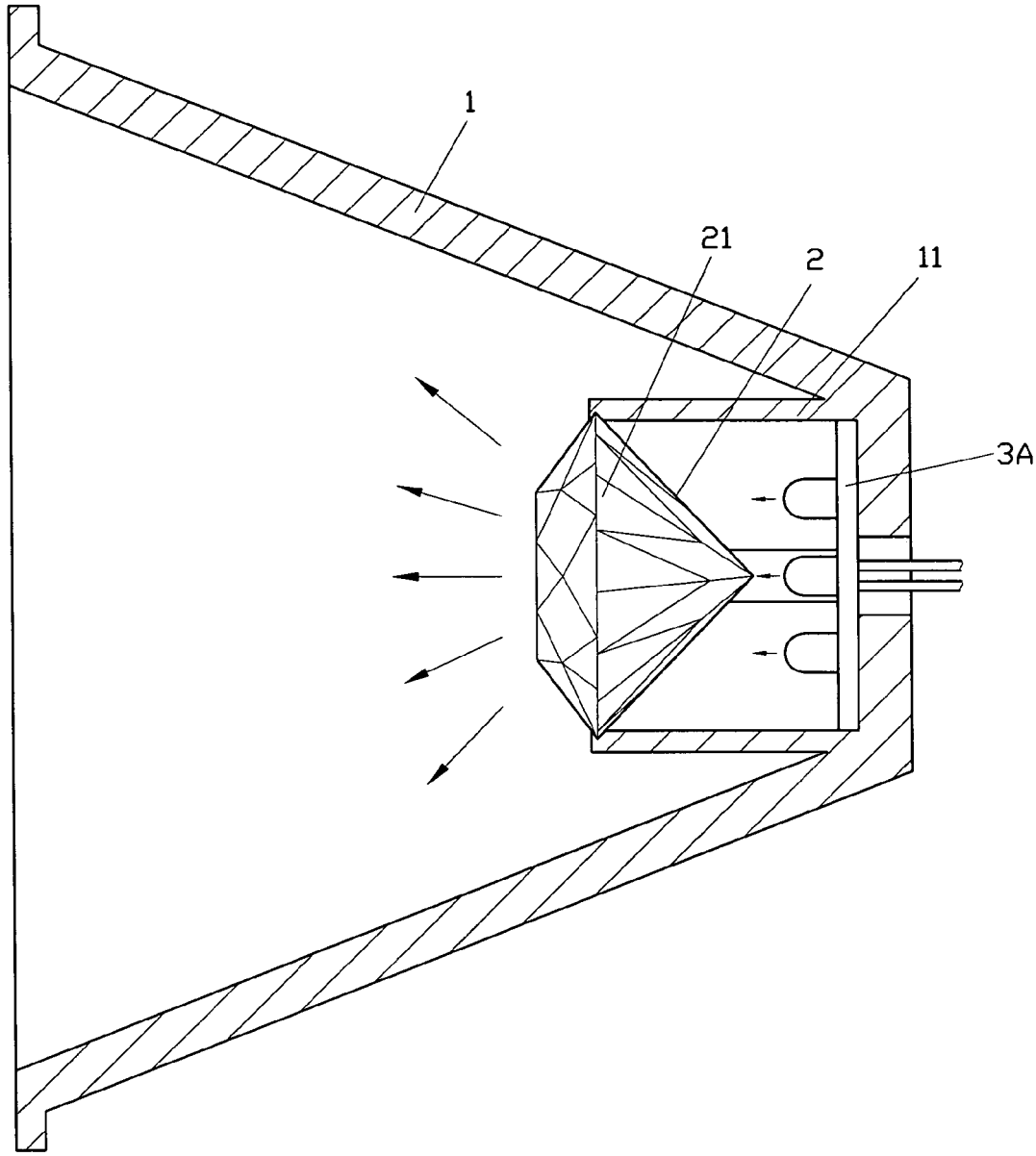
FIG. 2 is a cross-sectional view of a second embodiment of the present invention.

A second embodiment of the present invention, as shown in FIG. 2, the lighting member 3A is relocated in the holding section 11 of the shell 1 and behind the gem stone 2. The lighting member 3A will shine the bottom of the gem stone 2, and the gem stone 2 will reflect or refract the light from all of its cutting surfaces 21. The illumination will produce a different effect.

For the above two embodiments, the gem stone 2 may reflect or refract light from an outside light source without the requirement of lighting members 3 in the shell 1 to produce the same dazzling light effect.

Figure 3:
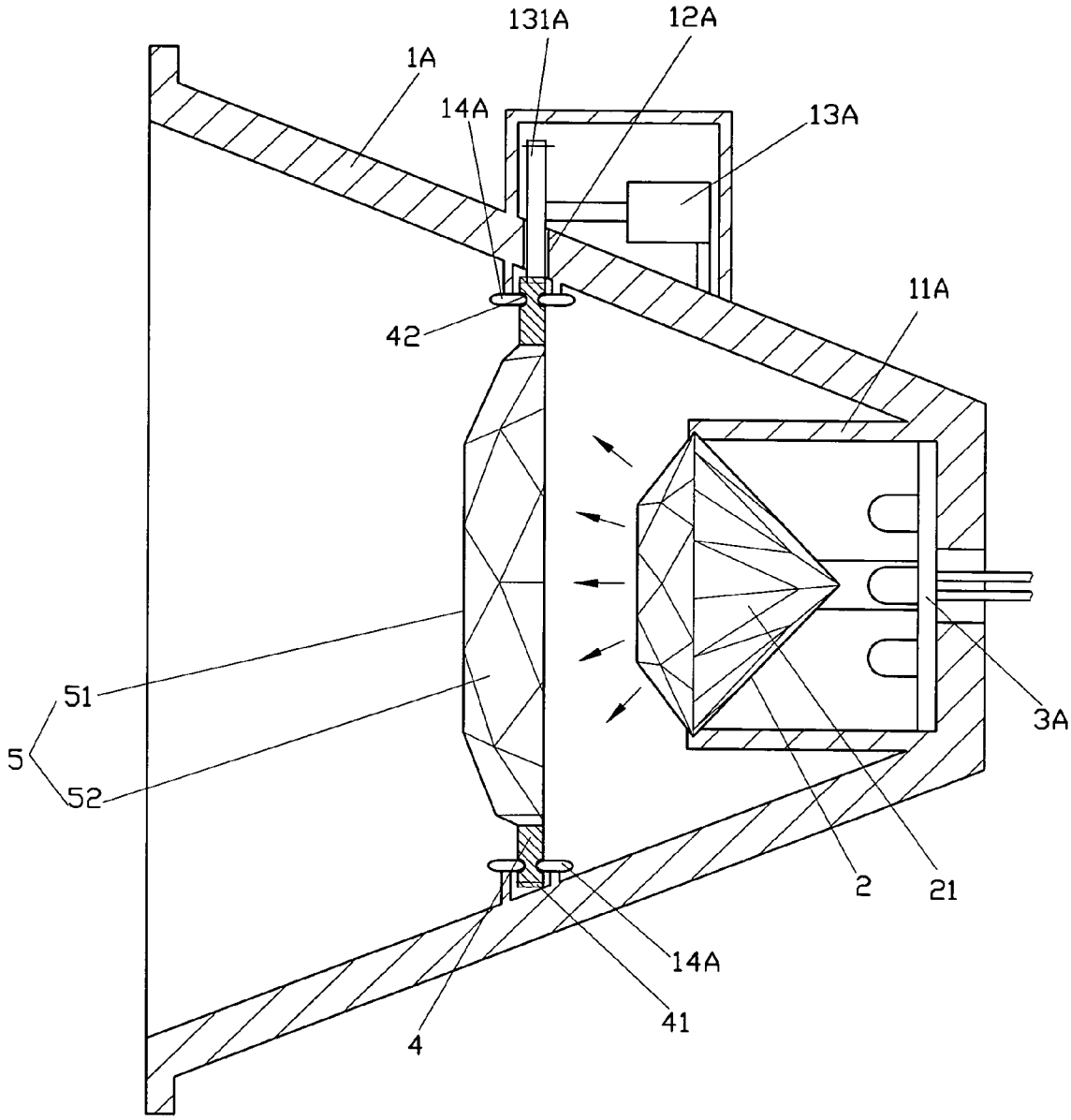
FIG. 3 is a cross-sectional view of a third embodiment of the present invention.

A third embodiment is illustrated in FIG. 3, which comprises other than the shell 1A, the gem stone 2 and the lighting member 3A, a connecting ring 4 and a first lamp shade 5.

The shell 1A comprises a holding section 11A on the inner wall, a notch 12A at the outer ridge, and a transmission device 13A corresponding to the notch 12A. The transmission device 13A has a transmission wheel 131A seating on the notch 12A. The transmission device 13A is best to be a motor. The shell 1A is provided with a supporting section 14A secured on the inner edge corresponding to the notch 12A. The supporting section 14A is an auxiliary wheel in this embodiment.

The connecting ring 4 comprises a gear 41 on its outer edge adapted to mesh with the transmission device 13A, and is connected with the first lamp shade 5 at the inner edge of the connecting ring 4. A trough 42 is formed between the inner edge and the outer edge of the connecting ring 4.

The first lamp shade 5 is made of transparent material having a protuberance surface 51 at one side with a plurality of refracting surfaces 52.

The first lamp shade 5 is fastened into the trough 42 of the connecting ring 4 with the gear 41 meshing with the transmission wheel 131A of the transmission device 13A. The connecting ring 4 is driven to rotate in relation to the gem stone 2 by the transmission wheel 131A of the transmission device 13A. The cutting surfaces 21 of the gem stone 2 reflect or refract the light to the refracting surfaces 52 of the protuberance surface 51 of the first lamp shade 5 to produce multiple reflections or refractions.

Figure 4:
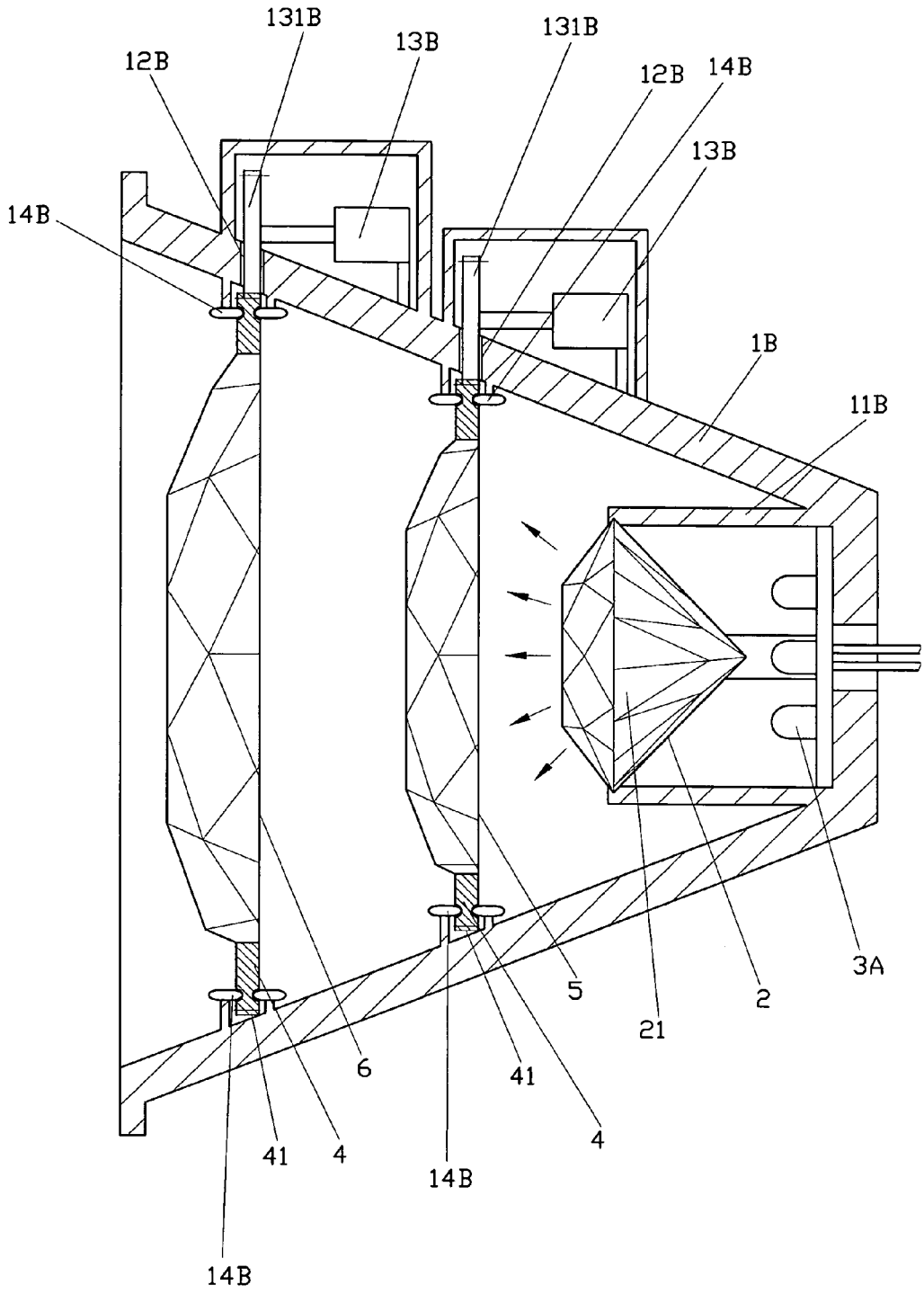
FIG. 4 is a cross-sectional view of a fourth embodiment of the present invention.

A fourth embodiment of the present invention, as shown in FIG. 4, is to add a second lamp shade 6 which is mounted on a second notch 12B of a shell 1B, and a second transmission device 13B is also secured to the shell 1B with another transmission wheel 131B extending into the second notch 12B. The inner wall of the shell 1B is also formed with a supporting section 14B. The supporting section 14B is an auxiliary wheel in this embodiment.

The second lamp shade 6 is connected to the connecting ring 4 at its outer edge. The gear 41 of the connecting ring 4 meshes with the transmission wheel 131B of the transmission device 13B, thus the second lamp shade 6 may be rotated with respect to the first lamp shade 5.

To practice, the two transmission devices 13B link the first lamp shade 5 and the second lamp shade 6 to rotate in an opposing direction.

Figure 5:
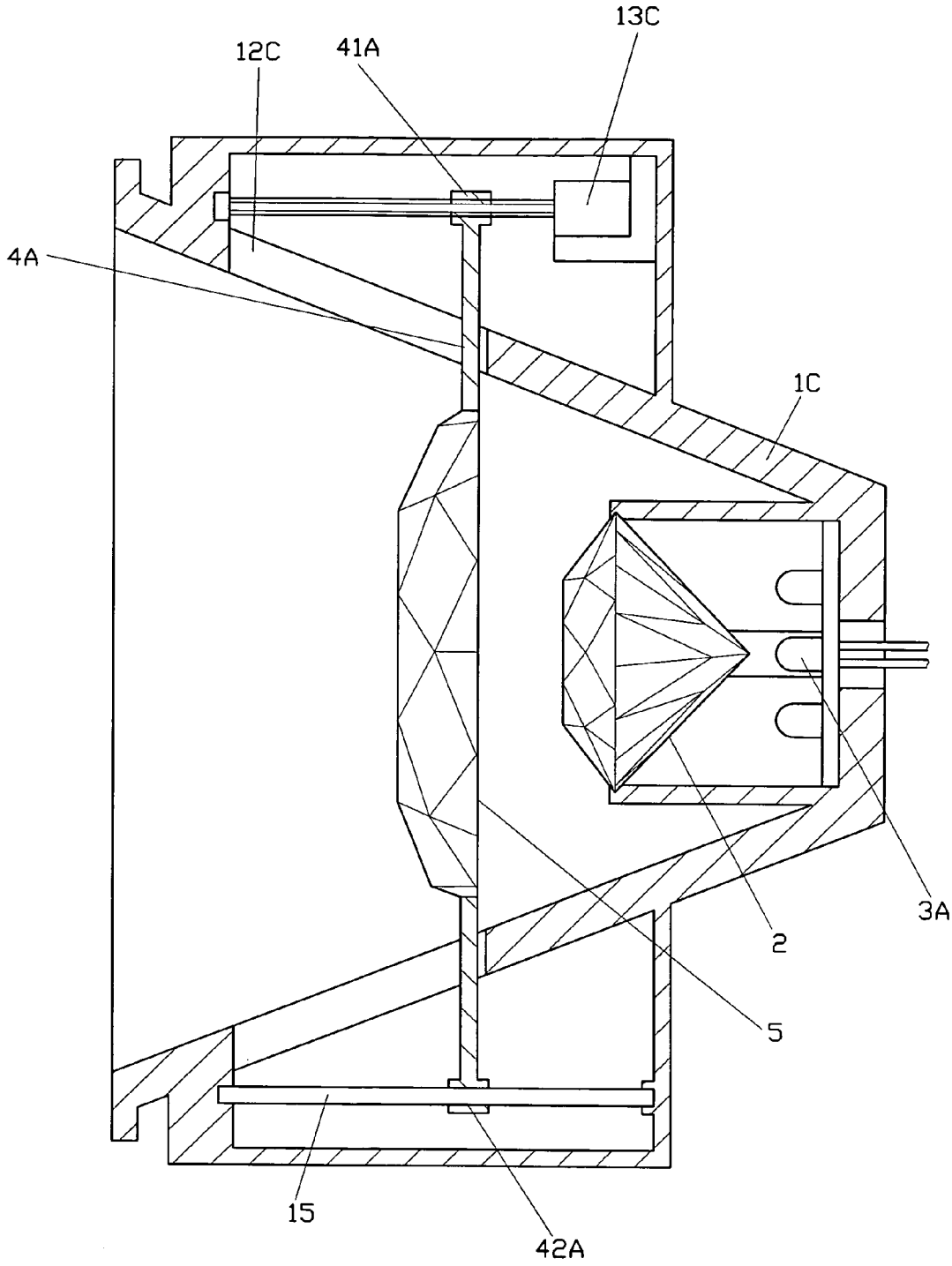
FIG. 5 is a cross-sectional view of a fifth embodiment of the present invention.

A fifth embodiment of the present invention, as shown in FIG. 5, comprises a shell 1C having a sliding trough 12C. The shell 1C is provided with a transmission device 13C at its outer edge. The transmission device 13C comprises a leading screw as its spindle. The connecting ring 4A connected with the first lamp shade 5 has a sleeve 41A extending from its outer edge. The sleeve 41A is formed with inner threads therein. The connecting ring 4A extends outwardly from the sliding trough 12C to connect with the spindle of the transmission device 13C, while the connecting ring 4A is formed with at least one pivoting hole 42A at its outer edge in relation to the sleeve 41A for insertion of a guiding rod 15 pivotally connected to the inner wall of the shell 1C.

When the spindle of the transmission device 13C rotates, the connecting ring 4A links the sleeve 41A and the first lamp shade 5 to slide along the guiding rod 15 in a linear direction in relation to the gem stone 2. This distance change will produce a different lighting effect as well.

Figure 6:
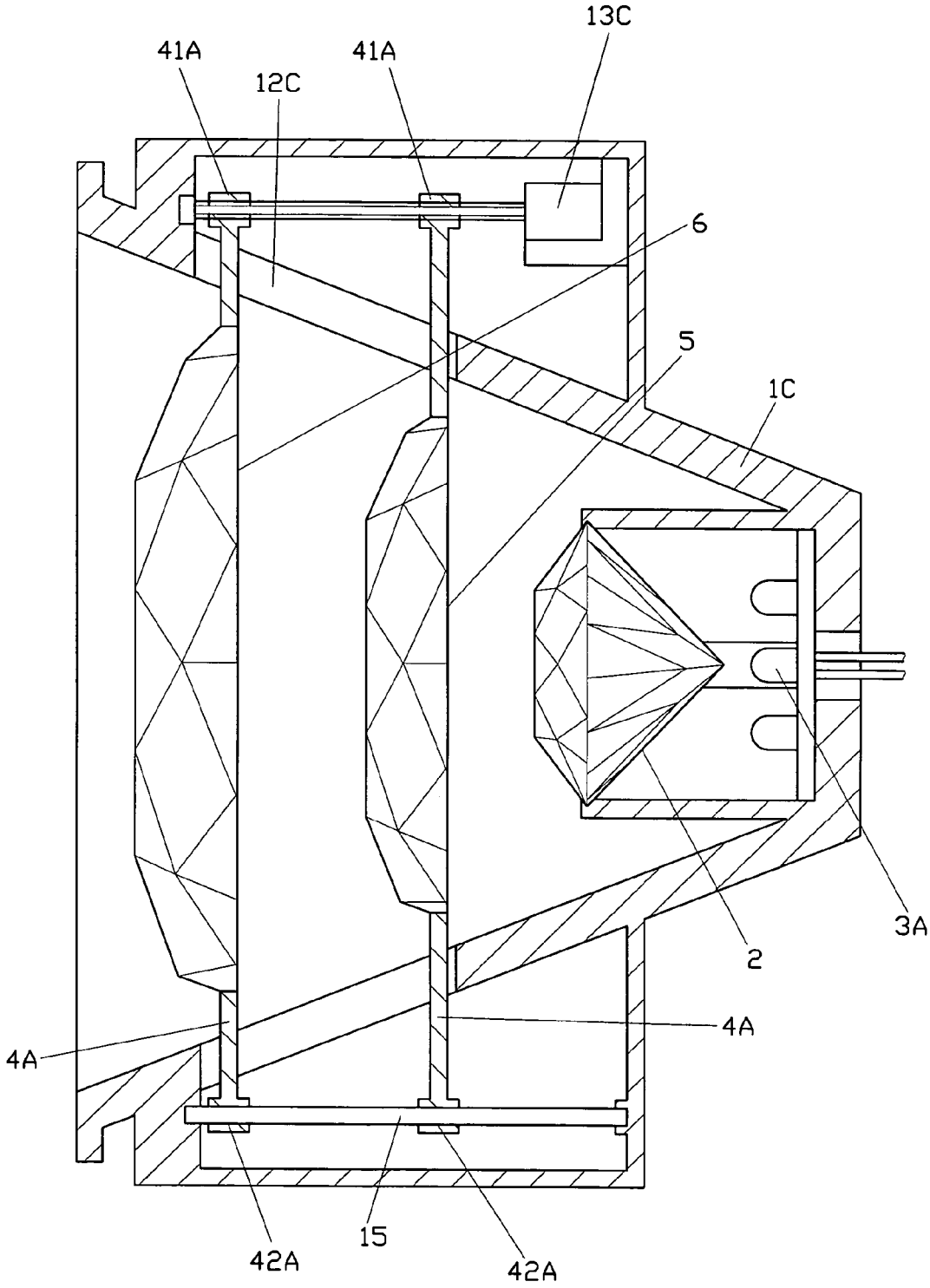
FIG. 6 is a cross-sectional view of a sixth embodiment of the present invention.

A sixth embodiment, as shown in FIG. 6, other than fifth embodiment is to add a unit of a second lamp shade 6 and a second connecting ring 4A to the shell 1C. The second lamp shade 6 and the second connecting ring 4A are driven by the transmission device 13C. Each connecting ring 4A is provided with the sleeve 41A and the pivoting hole (42A) to receive the spindle of the transmission device 13C and the guiding rod (15) therein.

In practice, when the transmission device 13C is activated, the first lamp shade 5 and the second lamp shade 6 are linked to move in a linear direction in relation to the gem stone 2. This makes the light provide an even dazzling effect. The first lamp shade 5 and the second lamp shade 6 of this embodiment are linked by the transmission device 13C to move closer or farther in an opposite direction.

Figure 7:
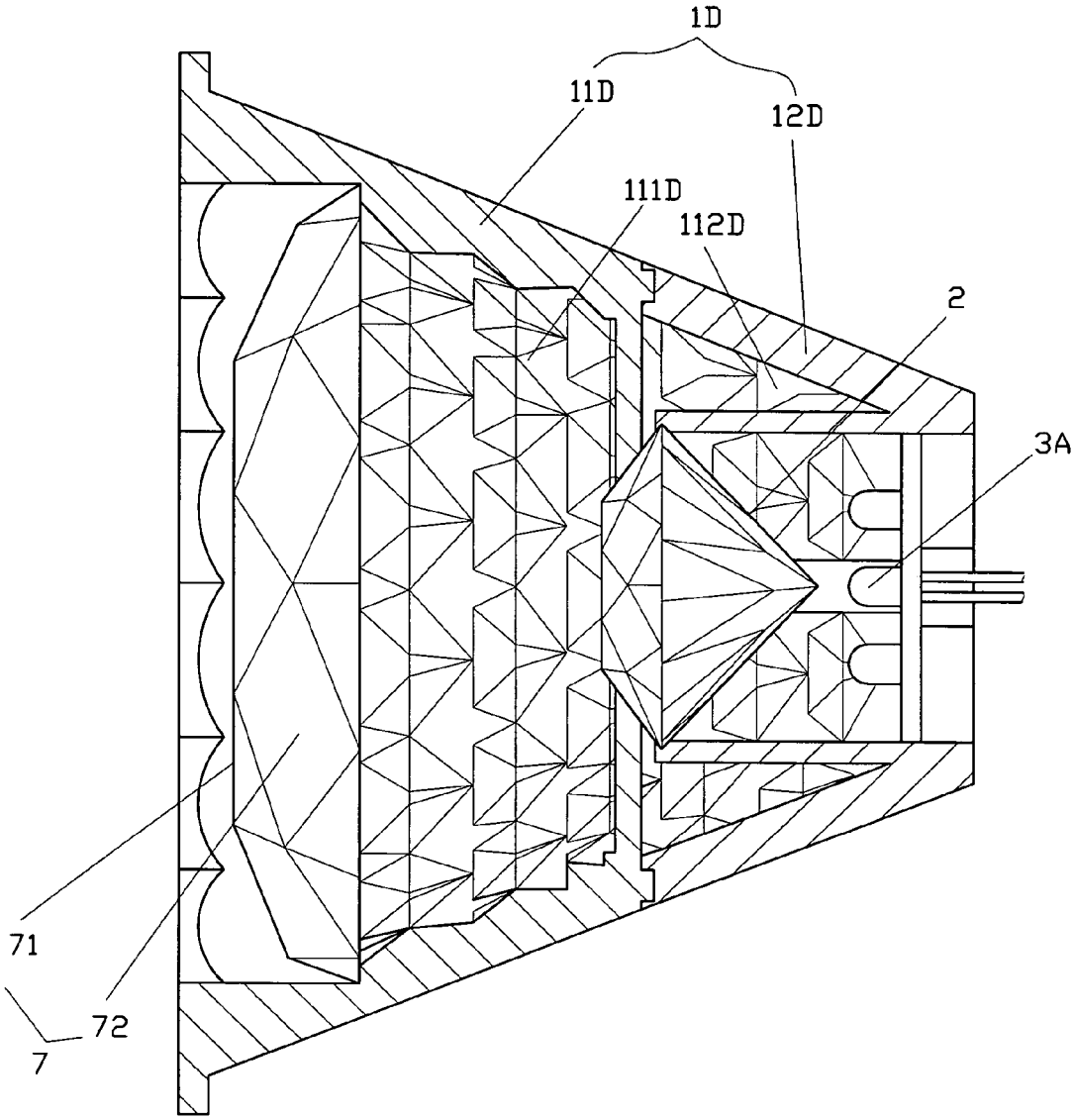
FIG. 7 is a cross-sectional view of a seventh embodiment of the present invention.

A seventh embodiment of the present invention as shown in FIG. 7, comprises a shell 1D. The shell 1D is consisted of a first shell 11D and a second shell 12D. Both the first shell 11D and the second shell 12D comprise reflecting surfaces 111D and 112D at the inner walls, respectively. The shell 11D further comprises a shade 7 with a protuberance surface 71 thereon. The protuberance surface 71 has a plurality of refracting surfaces 72. When the lighting member 3A shines the gem stone 2, the light reflects or refracts from the gem stone 2 to the reflecting surfaces 111D and 112D of the first shell 11D and the second shell 12D and makes multiple reflections of the light through the reflecting surfaces 111D and 112D before the light goes to the shade 7 which makes another reflection and refraction through the refracting surfaces 72.

I claim:

1. A dazzling light device comprising a shell, a gem stone and one or several lighting members, wherein said shell comprising a holding section to hold said gem stone therein, and said one or several lighting members secured on said shell and shining on said gem stone to produce dazzling light through reflection or refraction of said gem stone, said shell including (a) a first lamp shade corresponding to said gem stone, and (b) a transmission device connected with said first lamp shade to link said first lamp shade to rotate in relation to said gem stone.

2. The dazzling light device, as recited in claim 1, wherein said shell further comprises a second lamp shade corresponding to said first lamp shade.

3. The dazzling light device, as recited in claim 2, wherein said shell comprises a transmission device connected with said second lamp shade to link said second lamp shade to rotate in relation to said first lamp shade.

4. The dazzling light device, as recited in claim 2, wherein said shell comprises a transmission device connected with said second lamp shade to move said second lamp shade in a linear direction in relation to said gem stone.

5. The dazzling light device, as recited in claim 2, wherein said second lamp shade comprises a protuberance surface having a plurality of refracting surfaces thereon.

6. The dazzling light device, as recited in claim 1, wherein said shell comprises a first shell and a second shell connected with each other.

7. The dazzling light device, as recited in claim 1, wherein said shell comprises reflecting surfaces on an inner wall thereof.

8. A dazzling light device comprising a shell, a gem stone and at least one lighting member, wherein said shell includes a holding section to hold said gem stone therein, and said at least one lighting member being secured on said shell and shining on said gem stone to produce dazzling light through reflection or refraction of said gem stone, said shell including (a) a first lamp shade corresponding to said gem stone, and (b) a transmission device connected with said first lamp shade to move said first lamp shade in a linear direction in relation to said gem stone.

9. A dazzling light device comprising a shell, a gem stone and at least one lighting member, wherein said shell includes a holding section to hold said gem stone therein, and said at least one lighting member being secured on said shell and shining on said gem stone to produce dazzling light through reflection or refraction of said gem stone, said shell including a first lamp shade corresponding to said gem stone, and said first lamp shade comprising a protuberance surface having a plurality of refracting surfaces thereon.

* * * * *